US005224304A

United States Patent [19]

Cesna

[11] Patent Number: 5,224,304

[45] Date of Patent: Jul. 6, 1993

[54] AUTOMATED FREE ABRASIVE MACHINE FOR ONE SIDE PIECE PART MACHINING

[75] Inventor: Joseph V. Cesna, Niles, Ill.

[73] Assignee: Speedfam Corporation, Des Plaines, Ill.

[21] Appl. No.: 788,862

[22] Filed: Nov. 7, 1991

[51] Int. Cl.[5] ..... B24B 7/00; B24B 7/08

[52] U.S. Cl. ..... 51/281 R; 51/131.4; 51/215 H

[58] Field of Search ..... 51/109 R, 129, 131.1, 51/131.2, 131.4, 132, 215 R, 215 UE, 131.3, 281 SF, 283 R, 326, 281 R; 414/222, 225, 18

[56] References Cited

U.S. PATENT DOCUMENTS

| | | | |
|---|---|---|---|
| 1,588,739 | 6/1926 | Johnson | 51/215 HM |
| 3,304,662 | 2/1967 | Boettcher | 51/131.2 |
| 3,374,582 | 3/1968 | Boettcher | 51/131.2 |
| 3,377,750 | 4/1968 | Day | 51/131.2 |
| 3,443,342 | 5/1969 | Schulz | 51/215 R |

*Primary Examiner*—William E. Terrell
*Assistant Examiner*—Bryan Reichenbach
*Attorney, Agent, or Firm*—Fitch, Even, Tabin & Flannery

[57] ABSTRACT

An automated free abrasive apparatus for machining substantially similar workpieces on one side. In the apparatus a plurality of substantially similar workpieces are oriented and arranged in a lay flat configuration. Thereafter transport elements transfer the oriented laid flat workpieces to an indexing table which is movable vertically and horizontally to transport the workpieces to a machining area wherein the workpieces are machined. The orientation and machining or lapping of the workpieces is accomplished automatically without the need for an operator feeding each workpiece into the machining operation.

16 Claims, 2 Drawing Sheets

FIG. 4
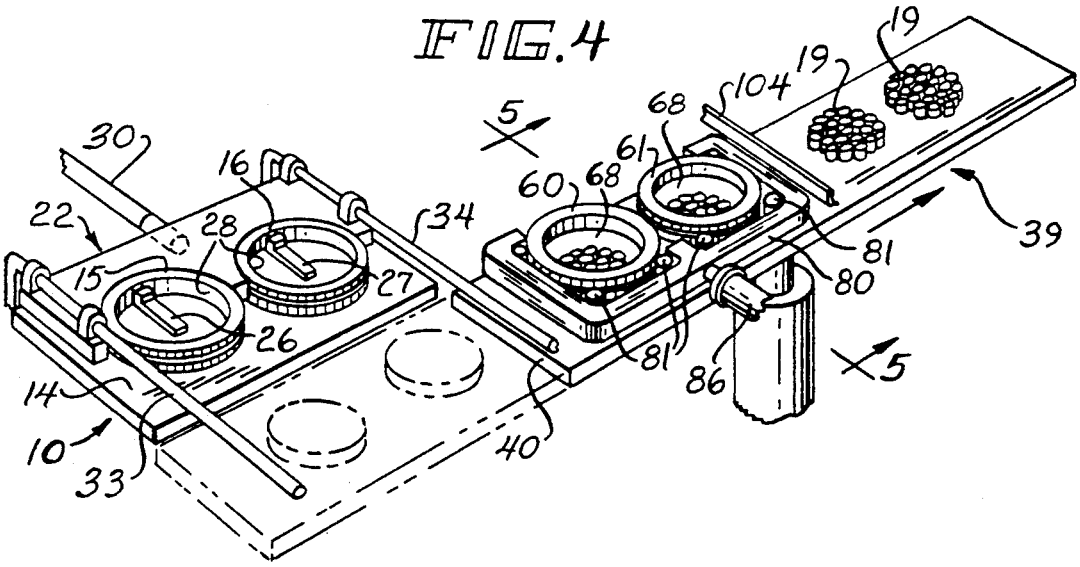
FIG. 5
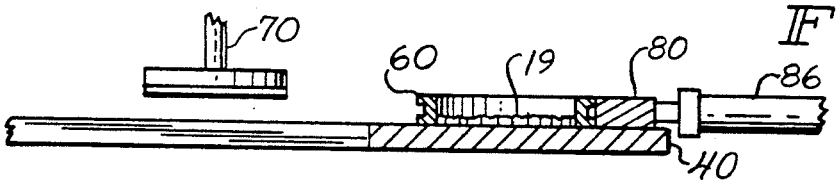
FIG. 6
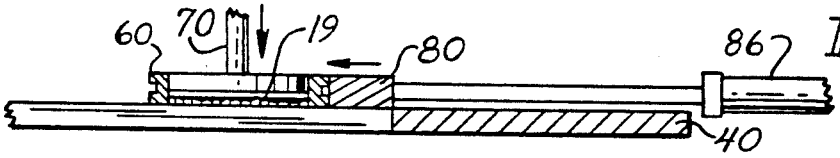
FIG. 7
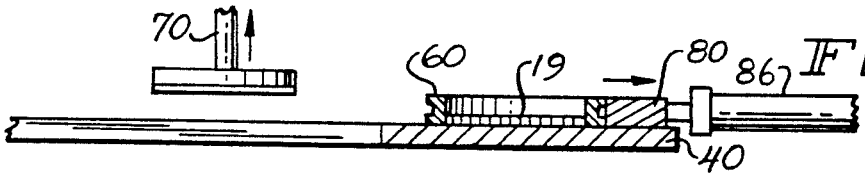
FIG. 8
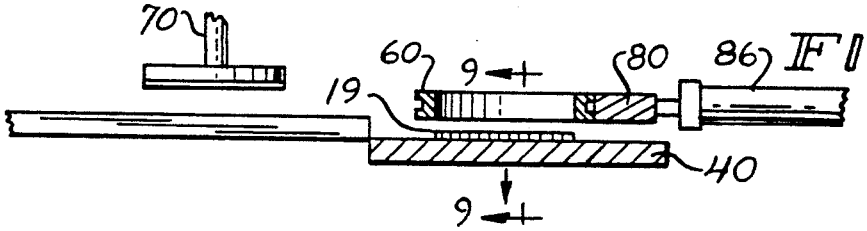
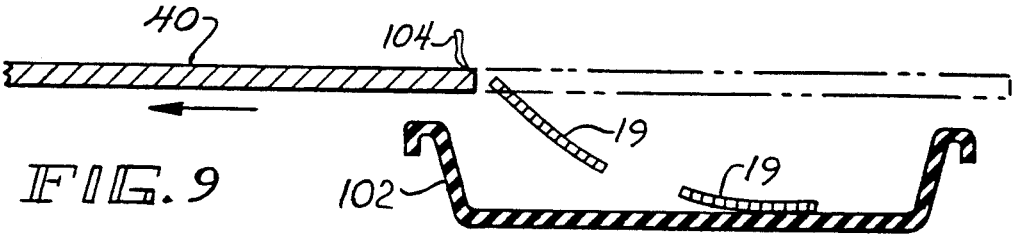
FIG. 9

AUTOMATED FREE ABRASIVE MACHINE FOR ONE SIDE PIECE PART MACHINING

FIELD OF THE INVENTION

The invention relates to lapping devices for machining one side of a workpiece. More particularly the present invention relates to an apparatus for automating the entire lapping machining process including loading parts to be machined, machining, and unloading machined parts.

BACKGROUND OF THE INVENTION

Free abrasive machining devices or lapping wheels are well known in the art and generally operate by introducing an abrasive to a rotating wheel to smooth a surface of a substantially flat part to be used as a component in a particular device. Free abrasive machines generally comprise a flat annular rotatable wheel on which are disposed a plurality of work stations. Each station is defined by a large heavy retaining ring having an interior space containing workpieces to be machined. The surfaces of the workpieces are machined by the retaining rings holding the workpieces in a given position relative to the rotating wheel. Additional pressure is applied to the workpieces contained within the retaining rings by pressure plates disposed above the retaining rings which fit within the interior diameter of the retaining rings to apply a downward pressure on the workpieces against the rotating wheel. An abrasive usually suspended in some type of liquid is released onto the lapping wheel for grinding and smoothing the pieces.

The loading, unloading and positioning of the pieces on the lapping wheel has in the past been done manually. By performing this operation manually an attendant is required to be stationed by the machine practically at all times. This often causes higher operating expenses in the form of wages, insurance, injuries, inaccuracy, fatigue and the like.

Other attempts at automation have not completely eliminated the need for an operator or have not decreased the down time of the machine needed for loading and unloading the pieces to be machined. For example, the automated loading and unloading means disclosed in Schulz, U.S. Pat. No. 3,443,342, requires several loading and unloading steps of the lapping wheel. Since the lapping wheel laps three wear rings of articles at a time, and since only one ring is loaded or unloaded from the lapping wheel at any one time, the running time of the lapping wheel is one third the total time required to produce a finished article. Consequently, the actual cycle time for lapping a workpiece is increased by the length of time required to load and unload each wear ring. This stopping and starting of the lapping wheel before a workpiece is completely finished, necessarily increases the downtime of the device.

SUMMARY OF THE INVENTION

Accordingly it is a principle object of this invention to provide a completely automated free abrasive machining device. Another object of the present invention is to provide a device that eliminates the need for an operator thus increasing the efficiency of the device by eliminating operator fatigue and error.

One aspect of the present invention is an apparatus for automatically lapping a plurality of substantially similar workpieces. The apparatus generally comprises a positioner, a pair of annular members disposed about a pair of rotating discs, an indexing table, means for moving the indexing table horizontally and vertically, a first transport means for moving workpieces between the rotating discs and the indexing table, means for lapping the workpieces and a second transport means for moving workpieces between the indexing table and the lapping means.

The positioner similarly orients a plurality of substantially similar workpieces. The rotating discs receive workpieces from the positioner and arrange the workpieces in a circular lay flat configuration defined by the annular members disposed about the rotating discs.

The indexing table is a substantially planar surface adjacent the rotating discs, and is additionally adjacent the lapping means. The indexing table is manipulated by an indexing means for moving the table horizontally and vertically. The first transport means preferably includes an air cylinder for moving workpieces disposed in the area defined by the annular members by sliding the annular members and workpieces from the surface of the rotating discs to the surface of indexing table.

The lapping means preferably comprises a lapping wheel, retaining rings for maintaining the workpieces in a circular lay flat configuration, pressure plates for insuring contact between the workpieces and the lapping wheel and a reversing gear engaging a dressing ring to maintain a uniform surface on the lapping wheel. Thus the indexing table and the first and second transport means provide a structure that automatically and continuously machines workpieces without the need for an operator.

Another aspect of the present invention is a method for automatically machining one side of a workpiece. A plurality of similar workpieces are oriented with the same side of each workpiece disposed in a uniform direction. The workpieces are then arranged in a predetermined lay flat configuration. The workpieces are then transported to an adjacent indexing table. Simultaneously, a similar configuration of finished workpieces are transported from a lapping means to said indexing table. The indexing table with unfinished workpieces in a lay flat configuration at one end and finished workpieces in a lay flat configuration at the other end is then lowered and moved laterally. The indexing table is then raised and the unfinished workpieces are transported into the lapping means and the finished workpieces are transported to other finishing machinery. The indexing table is then lowered and returned to its original position to begin the process anew.

BRIEF DESCRIPTION OF THE DRAWINGS

The features of the present invention are set out in detail in the detailed description and appended claims. Certain aspects of the present invention have been indicated in the foregoing introduction and summary. Other and further objects, features and advantages will be apparent to those skilled in the art, in the following detailed description taken in conjunction with drawings in which

FIG. 4 is a perspective view of the present invention illustrating the indexing table displaced horizontally;

FIGS. 5-8 are side views of the present invention illustrating the second transport means in operation.

FIG. 9 is a sectional view of the present invention illustrating the indexing table fully displaced laterally with finished workpieces.

DETAILED DESCRIPTION OF THE PREFERRED EMBODIMENT

Figure 1:
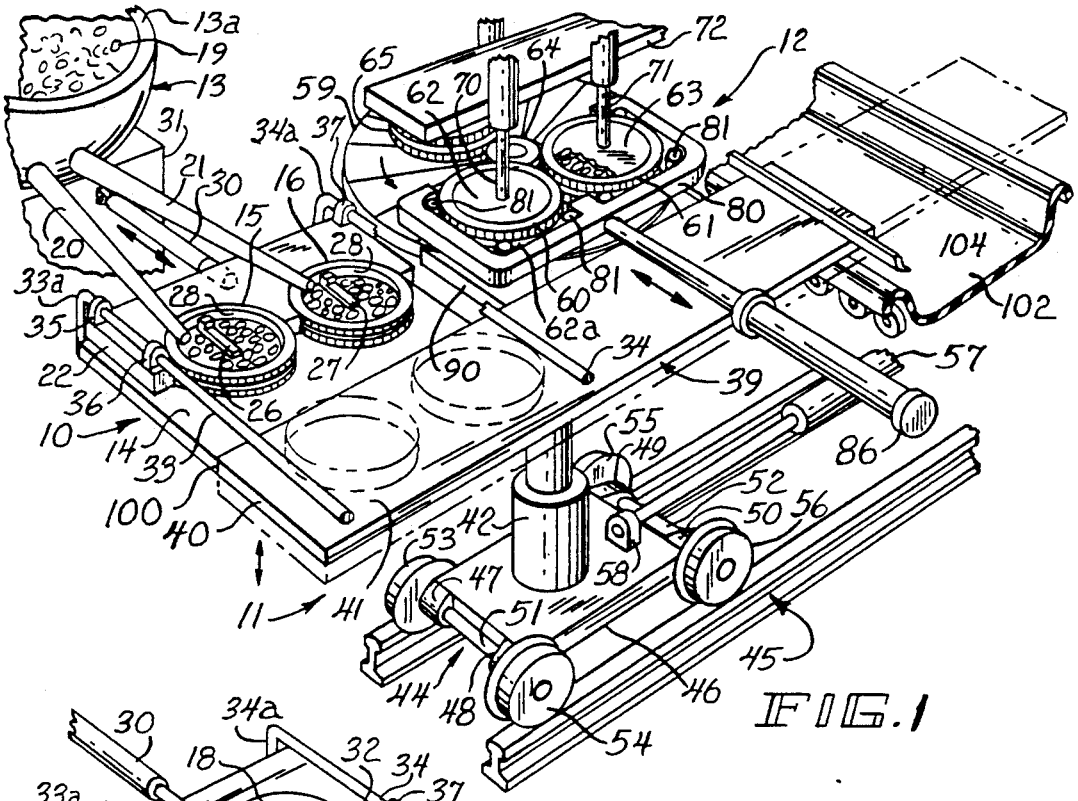
FIG. 1 is a front elevated perspective view illustrating one embodiment of the present invention.

The present invention is shown generally in FIG. 1 comprising, the staging area 10, the indexing area 11, and the machining area 12.

Figure 2:
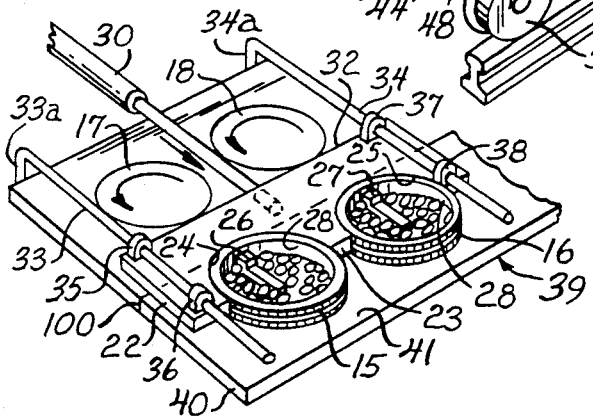
FIG. 2 is a front elevated perspective view illustrating the first transport means in its extended position.

The staging area 10 comprises a positioner 13, an arranging surface 14, and a pair of annular members 15 and 16 disposed about a pair of rotating discs 17 and 18 as shown in FIGS. 1 and 2.

The positioner 13 may be of any commercially available type which vibrates and detects the unfinished workpieces 19 or uses other means so that the desired side of the workpieces 19 to be finished is disposed facing downwardly as is understood by those skilled in the art. The positioner 13 includes a large holding container 13*a* for receiving a plurality of unfinished workpieces 19.

Extending at a slightly downward angle from the positioner 13 are ramps 20 and 21. The ramps 20 and 21 extend to the surface of rotating discs 17 and 18 respectively and serve as the conduit for the workpieces 19 from the positioner 13 to the discs 17 and 18. The positioner also includes a well known means (not shown) for controlling the number of workpieces exiting the ramps 20 and 21.

Adjacent to the positioner 13 is an arranging surface 14. Arranging surface 14 is a generally rectangular planar surface preferably made of a material having a low coefficient of friction. As seen in FIG. 2, the rotating discs 17 and 18 are disposed generally in the center of the arranging surface 14 and coplanar therewith. The discs 17 and 18 are rotatable about their vertical axis by any standard electrical motor (not shown) which would be mounted on the underside of the arranging surface 14 as is commonly understood by those skilled in the art.

Resting on the arranging surface 14 is a generally rectangular pusher plate 22. Along one elongated edge 23 of pusher plate 22 are two recesses 24 and 25 each of which in this embodiment are shaped to conform to the outer surface of the annular members 15 and 16. Recesses 24 and 25 provide space so that annular members 15 and 16 may be fixedly attached to pusher plate 22.

Stopper bars 26 and 27 each extend perpendicularly from an interior wall 28 of annular members 15 and 16 respectively and rest upon the surface of rotating discs 17 and 18. An air cylinder 30 extending from a base 31 of the positioner 13 is affixed to the other elongated edge 32 of the pusher plate 22.

Pusher plate 22 and annular members 15 and 16 move laterally maintaining contact with the arranging surface 14 when air cylinder 30 is extended. The pusher plate 22 and annular members 15 and 16 are maintained along a path by guide rods 33 and 34. Guide rods 33 and 34 are fixedly attached to the arranging surface 14 by end plates 33*a* and 34*a* respectively. Guide rods 33 and 34 extend horizontally through bushings 35 through 38 disposed at each corner of pusher plate 22 as seen in FIG. 2.

As seen in FIG. 1 the indexing area 11 comprises a vertically and horizontally movable indexing table 39. The indexing table 39 is adjacent to and abuts the arranging surface 14. The indexing table 39 is a generally rectangular table approximately equivalent in width to the arranging surface 14, and approximately twice as long.

Indexing table 39 comprises a rigid plate 40 having a generally planar surface 41. The plate 40, similar to the arranging surface 14, is preferably made of a sturdy material having a low coefficient of friction. Plate 40 is supported by an air cylinder 42 affixed to the underside 43 of plate 40.

Air cylinder 42 is vertically mounted on a car 44 that is movable along track 45. Car 44 includes a rigid base 46 having four bushings 47 through 50 disposed horizontally at each corner of base 46. Axles 51 and 52 extend horizontally through bushings 47 and 48, and 49 and 50 respectively. Wheels 53 through 56 are fixedly attached to each end of the axles 51 and 52 for rotation and engagement with the track 45. Car 44 is moved along track 45 by any conventional power means, preferably a horizontally disposed air cylinder 57 attached to a coupler 58 connected to the base 46.

The machining area 12 may be similar to any conventional lapping wheel mechanism, such as the forty-eight inch free abrasive machining device manufactured by Speedfam Corporation or as known by those skilled in the art. The machining area of the embodiment shown in FIG. 1 comprises a lapping wheel 59, retaining rings 60 and 61, pusher plates 62 and 63, a reversing gear 64 and a dressing ring 65.

The lapping wheel 59 is a circular steel alloy surface disposed horizontally and rotated about a vertical axis by suitable drive means (not shown) known by those skilled in the art.

A reversing gear 64 is disposed about the center of lapping wheel 59. The reversing gear 64 is annular in shape, having a gear-tooth outer circumference. The reversing gear 64 is driven by a separate drive means (distinct from the drive means for the lapping wheel 59) which is capable of rotating the reversing gear 64 in either a clockwise or counterclockwise direction. The lapping wheel 59 is rotated in a counterclockwise direction as illustrated.

Disposed on the surface of the lapping wheel 59 is an annular dressing ring 65. Dressing ring 65 includes a gear toothed outer circumference that engages the gear teeth of the reversing gear 64. The dressing ring 65 additionally engages the surface of the lapping wheel 59 and acts as a leveling device to maintain the flatness of the lapping wheel 59. The reversing gear 64 engages the dressing ring 65 and rotates it clockwise or counterclockwise to act as the leveling device to maintain the flatness of the lapping wheel.

Figure 3:
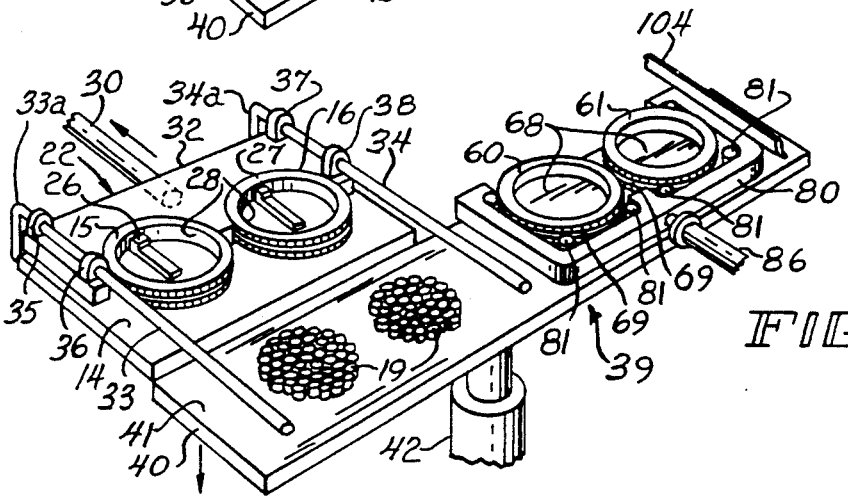
FIG. 3 is a front perspective view of the present invention illustrating the first transport means and the indexing table.

The pair of retaining rings 60 and 61 similar in size to the dressing ring 65 are also disposed on the surface of lapping wheel 59. Each of the retaining rings 60 and 61 have an interior area 68 and have a smooth outer circumference 69 as seen in FIG. 3. The retaining rings 60 and 61 do not engage reversing gear 64, but are free to rotate about their center of axis.

Disposed directly above retaining rings 60 and 61 are pusher plates 62 and 63. Pusher plates 62 and 63 comprise horizontally disposed flat circular plates having a diameter just slightly smaller than the diameter of the interior space 68 defined by each of the retaining rings 60 and 61. When workpieces are being machined, the workpieces are generally disposed within the space 68 defined by the retaining rings 60 and 61. Air cylinders 70 and 71 disposed vertically and connected at one end to a support beam 72 of the free abrasive machining device 12 and connected at the other end to the center of the pusher plates 62 and 63, move the pusher plates 62 and 63 downwardly into the interior spaces 68 defined by the retaining rings 60 and 61. The pusher plates 62 and 63 engage the workpieces 19 and provide a downward force holding the workpieces 19 in a fixed position relative to the rotating lapping wheel 59.

Retaining rings 60 and 61 are further held in place on the lapping wheel 59 by U-shaped pusher plate 80. Disposed about the interior area of U-shaped pusher plate 80 are a plurality of bearings 81. The retaining rings 60 and 61 include a small groove 62*a* about the circumference which engages the bearings 81 of U-shaped pusher plate 80. The grooves allow the pusher plate 80 to fixedly attach to retaining rings 60 and 61 and support the retaining rings 60 and 61 as shown in FIGS. 1 and 3 and at the same time allow retaining rings 60 and 61 to be rotatable about their vertical axis.

U-shaped pusher plate 80 is attached to air cylinder 86 which is disposed horizontally and moves the U-shaped pusher plate 80 between the lapping wheel 59 and the indexing table 39. It should be noted that U-shaped pusher plate 80 does not contact the lapping wheel 59 or the indexing table 39, but does support retaining rings 60 and 61 when the retaining rings 60 and 61 are not supported by either the lapping wheel 59 or the indexing table 37 as seen in FIG. 8.

The machining area further comprises a table extension 90 that fits between the lapping wheel 59 and indexing table 39 to allow a continuous surface for sliding workpieces 19 and the retaining rings 60 and 61 between the lapping wheel 59 and the indexing table 39.

The present invention begins operation when a plurality of unfinished workpieces are loaded into holding container 13*a* of positioner 13. Positioner 13, in a manner well known in the art, arranges the workpieces such that the same side of each workpiece 19 is disposed downwardly. The similarly disposed workpieces 19 are then fed through ramps 20 and 21 by gravity and onto the surface of the rotating discs 17 and 18. Annular members 15 and 16 disposed about the rotating disks 17 and 18 maintain the workpiece in a lay flat circular configuration. While the workpieces 19 are being fed, the rotating disks 17 and 18 are moving in a counterclockwise position as illustrated. As pieces are fed to the rotating disks, the stopper bars 26 and 27 extending from the annular members above the discs 17 and 18, hold the workpieces 19 in a fixed position relative to the disks 17 and 18 to create and maintain an open surface so that additional workpieces can be fed onto the discs 17 and 18. The workpieces 19 are continually fed onto the discs 17 and 18 and are contained by annular members 15 and 16 until the surface of the discs are covered by workpieces 19 disposed in a lay flat configuration.

A suitable counting means (not shown) may be used to determine the number of workpieces fed to the rotating discs 17 and 18 as would be understood by those skilled in the art. Once the rotating discs 17 and 18 are loaded with workpieces according to the predetermined count, the counting means will signal air cylinder 30 to extend, displacing pusher plate 22 which is rigidly affixed to the annular members 15 and 16. Workpieces 19, disposed in a lay-flat configuration in the interior space defined by annular members 15 and 16, are moved horizontally along arranging surface 14 onto one end of the indexing table 39. While the annular members 15 and 16 are moved horizontally, the workpieces 19 are maintained in a lay-flat configuration and slide easily across arranging surface 14. The surface of indexing table 39, although generally coplanar with arranging surface 14, may be just slightly vertically lower to ensure that workpieces 19 contained within annular members 15 and 16 do not flip over or stack on each other when they are slid across a seam 100 between arranging surface and indexing table 39. For instance, as shown in FIG. 2, annular members 15 and 16 have been moved to a position over indexing table 39.

Once the annular members 15 and 16 are arranged in contact over indexing table 39 and workpieces 19 are supported by indexing table 39, indexing table 39 is lowered by activating air cylinder 42, and pusher plate 22 is retracted back to its original position as seen in FIG. 3. As a result, workpieces 19 are arranged in a lay-flat circular configuration on one end of indexing table 39. At the same time that workpieces 19 are moved onto one end of indexing table 39, the air cylinder 86 connected to the U-shaped pusher plate 80 has pulled the retaining rings 60 and 61 onto the other end of indexing table 39. When the table is lowered as in FIG. 3, the retaining rings 60 and 61 and pusher plate 80 are maintained above indexing table 39 by the air cylinder 86.

Once the indexing table 39 has been lowered approximately 5 to 6 inches, the indexing table 39 is moved laterally along track 45 on car 44 such that the end of indexing table 39 where the workpieces 19 are disposed are now directly underneath retaining rings 60 and 61 supported by the U-shaped pusher plate 80 and the air cylinder 86 as seen in FIG. 8. The indexing table 39 is then raised by air cylinder 42 such that the surface of indexing table 39 now contacts the bottom surface of retaining rings 60 and 61. The surface of indexing table 39 is also coplanar with the surface of the lapping wheel 59 and the table extension 90. The workpieces 19, still in their circular lay flat configuration supported by indexing table 39 are additionally disposed in the interior area 68 defined by the retaining rings 60 and 61 as seen in FIG. 5.

As shown in FIG. 6, the air cylinder 86 is then extended moving the U-shaped pusher plate 80 laterally inwardly such that the retaining rings 60 and 61 and the workpieces 19 disposed within the interior surface of the retaining rings 60 and 61 are now disposed on the lapping wheel 59. It should be noted that U-shaped pusher plate 80 does not contact the surface of the lapping wheel 59. Again, although generally co-planar with the lapping wheel and table extension 90, the indexing table 39 may be slightly raised above the surface of lapping wheel 59 in order to ensure that workpieces 19 do not flip over as they are slid across indexing table 39 and lapping wheel 59 into position on lapping wheel 59.

Once the retaining rings 60 and 61 along with workpieces 19 are disposed on the lapping wheel 59, vertical pusher plates 62 and 63 are moved downwardly by air cylinders 70 and 72 such that they fit within the interior space 68 defined by the retaining rings 60 and 61 and push the workpieces 19 against the surface of the lapping wheel 59 as seen in FIG. 6. The lapping wheel 59 is then rotated and a liquid abrasive is introduced to the lapping wheel 59 and the workpieces 19 are machined in a manner well known in the art.

Once the machining is complete, the vertical pusher plates 62 and 63 are raised and air cylinder 86 connected to the U-shaped pusher plate 80 is retracted to slide the retaining rings 60 and 61 and the finished workpieces 19 laterally onto the indexing table 39 as seen in FIG. 7. It should be noted that the finished workpieces 19 now resting on indexing table 39 are disposed toward the right end of indexing table 39. At the same time the retaining rings 60 and 61 and workpieces 19 are disposed on the far right end of indexing table 39, unfinished workpieces 19 are also disposed by pusher plate 22 onto the left end of indexing table 39 in the manner previously described.

The indexing table 39 is then lowered by air cylinder 42 such that the finished workpieces 19 are maintained and rest upon indexing table 39 in a circular lay-flat configuration as seen in FIG. 8. At the same time, unfinished workpieces 19 are disposed on the surface of indexing table 39 as shown in FIG. 3. The indexing table 39, as before, is lowered and moved laterally along track 45 such that unfinished workpieces 19 disposed on indexing table 39 are beneath retaining rings 60 and 61. The table is then raised with the unfinished workpieces 19 being disposed in the interior spaces 68 defined by retaining rings 60 and 61, and the finished workpieces 19 being disposed on the surface of indexing table 39 as seen in FIG. 4. The unfinished workpieces 19 are then moved onto the lapping wheel 59 as before, while the now finished workpieces 19 are moved to other machinery by a conveyor 102 or other machinery as seen in FIG. 9. A pusher bar 104 is a rigid structure used to push the finished workpiece onto the conveyor 102. The pusher bar 104 is extended towards the conveyor 102, by means known to those skilled in the art, thereby moving the finished workpieces 19 onto the adjacent conveyor system 102.

This device provides a continuous supply of finished workpieces 19 with no machine operator required and minimal machine downtime, other than the necessity for the reloading of the positioner with unfinished workpieces 19 occasionally by an attendant. While the preferred embodiment of this invention has been described, it will be understood that the invention is not limited thereto since modifications may be made by those skilled in the art particularly in light of the foregoing teachings.

What is claimed is:

1. An apparatus for automatically lapping a plurality of substantially similar workpieces, comprising:

positioning means for similarly orienting a plurality of substantially similar workpieces;

an indexing table;

indexing means for horizontally and vertically moving said indexing table;

arranging means for arranging said workpieces into a predetermined configuration;

a first transport means for transporting said workpieces from said arranging means to said indexing table;

lapping means for lapping one side of the workpieces; and second transport means for moving said workpieces between said lapping means and said indexing table.

2. An automatic lapping apparatus in accordance with claim 1 wherein said positioning means comprises a vibrating container for holding substantially flat workpieces having a first side and a second side wherein said container orients the workpieces with one of said first or second sides facing downwardly.

3. An automatic lapping apparatus in accordance with claim 1 wherein said indexing means comprises a base plate, a power means for displacing the base plate horizontally, and a vertically disposed air cylinder mounted on said base plate and connected to the underside of said indexing table.

4. An automatic lapping apparatus in accordance with claim 1 wherein said arranging means comprises, a pair of flat rotatable discs having a predetermined diameter and surrounded by a substantially planar surface, means for rotating said discs, and a pair of annular members disposed about said discs.

5. An automatic lapping apparatus in accordance with claim 1 wherein said first transport means comprises an air cylinder.

6. An automatic lapping apparatus in accordance with claim 1 wherein said lapping means comprises a rotatable lapping wheel, a pair of retaining rings, pressure plates, a reversing gear, and a dressing ring engaging the reversing gear.

7. An automatic lapping apparatus in accordance with claim 1 wherein said second transport means comprises an air cylinder assembly for horizontally sliding said retaining rings between said lapping means and said indexing table.

8. An apparatus for automatically lapping a plurality of substantially similar workpieces comprising:

a positioner for similarly orienting a plurality of substantially similar workpieces;

a pair of rotating discs adjacent said positioner having a pair of annular members disposed about the rotating discs for arranging and maintaining said similarly oriented workpieces in a predetermined lay-flat configuration;

an indexing table adjacent said pair of rotating discs;

indexing means for moving said indexing table vertically and horizontally;

a first transport means for transporting said workpiece between said rotating discs and said indexing table;

a lapping wheel for machining a given side of said workpieces, said lapping wheel comprising, retaining rings for maintaining said workpieces in said predetermined configuration during machining, pressure plates for engaging said workpieces against said lapping wheel, a reversing gear and a dressing ring engaging said reversing gear for ensuring a uniform condition of said lapping wheel; and a second transport means for moving said workpieces between said lapping wheel and said indexing table.

9. An automatic lapping apparatus in accordance with claim 8 wherein said indexing means comprises a base plate, power means for displacing the base plate horizontally, and a vertically disposed air cylinder mounted on said base plate and connected to said indexing table.

10. An automatic lapping apparatus in accordance with claim 8 wherein said first transport means comprises an air cylinder for moving said pair of annular members between the rotating discs and said indexing table.

11. An automatic lapping apparatus in accordance with claim 8 wherein said second transport means comprises an air cylinder attached to said pair of retaining rings or horizontally sliding said retaining rings between said lapping wheel and said indexing table.

12. A method of automatically machining one side of a plurality of substantially similar unfinished workpieces comprising:

automatically orienting and arranging a plurality of unfinished workpieces is a substantially identical valid flat position for machining one side thereof;

automatically transporting the plurality of unfinished oriented and arranged workpieces to a machining area;

simultaneously machining the plurality of unfinished oriented and arranged workpieces and removing a plurality of machined workpieces from the machining area while simultaneously moving a plurality of unfinished oriented and arranged workpieces to a vertically and horizontally movable indexing table for transport to the machining area.

13. A method of automatically machining one said of a plurality of substantially similar unfinished workpieces comprising:

automatically orienting and arranging unfinished workpieces in a substantially identical laid flat position for machining one side thereof;

automatically transporting the oriented and arranged workpieces to a machining area by a vertically and horizontally movable indexing table;

machining the unfinished workpieces; and removing the machined workpieces from the machining area.

14. Apparatus for automatically and simultaneously machining a plurality of substantially similar workpieces comprising:

automatic means for arranging a plurality of unfinished workpieces in a laid flat position;

automatic means for transporting a plurality of the so-arranged unfinished workpieces to a machining area;

means for machining simultaneously a plurality of the so-arranged workpieces; and automatic means for removing a plurality of machined workpieces from the machining area simultaneously with the transfer of a plurality of unfinished workpieces from the automatic means for arranging to the automatic means for transport.

15. Apparatus in accordance with claim 14 wherein the means for transporting the so-arranged unfinished workpieces to the machining area is movable vertically and horizontally.

16. Apparatus for automatically machining a plurality of substantially similar workpieces comprising:

automatic means for arranging a plurality of unfinished workpieces in a laid flat position;

automatic means for transporting the so-arranged unfinished workpieces to a machining area;

automatic mans for transporting the so-arranged unfinished workpieces from the automatic means for arranging to the automatic means for transporting;

means for machining the so-arranged workpieces; and automatic means for removing the machined workpieces from the machining area wherein the automatic means for removing the machined workpieces and the automatic means or transporting the so-arranged unfinished workpieces operate simultaneously.

* * * * *

UNITED STATES PATENT AND TRADEMARK OFFICE

CERTIFICATE OF CORRECTION

PATENT NO. :5,224,304

DATED :July 6, 1993

INVENTOR(S) :Joseph V. Cesna

It is certified that error appears in the above-identified patent and that said Letters Patent is hereby corrected as shown below:

Column 2, line 60, after "with" insert -- the accompanying --

Column 8, line 67, change "or" to -- for --

Column 9, line 5, change "is" to -- in --

Column 9, line 19, change "said" to -- side --

Column 10, line 23, change "mans" to -- means --

Signed and Sealed this

Eighth Day of February, 1994

Bruce Lehman

*Attest:*

BRUCE LEHMAN

*Attesting Officer*

*Commissioner of Patents and Trademarks*